US009751095B2

(12) United States Patent
Honeyands et al.

(10) Patent No.: US 9,751,095 B2
(45) Date of Patent: Sep. 5, 2017

(54) SHOWER HEADS AND SHOWER APPARATUS

(75) Inventors: Peter James Honeyands, Axbridge (GB); Christopher Honeyands, Street (GB)

(73) Assignee: Kelda Showers Limited, Winchester (GB)

( * ) Notice: Subject to any disclaimer, the term of this patent is extended or adjusted under 35 U.S.C. 154(b) by 0 days.

(21) Appl. No.: 14/126,548

(22) PCT Filed: Jun. 21, 2012

(86) PCT No.: PCT/GB2012/051436

§ 371 (c)(1),
(2), (4) Date: Dec. 16, 2013

(87) PCT Pub. No.: WO2012/175966

PCT Pub. Date: Dec. 27, 2012

(65) Prior Publication Data

US 2014/0110504 A1 Apr. 24, 2014

(30) Foreign Application Priority Data

Jun. 22, 2011 (GB) ..... 1110533.5
Jun. 22, 2011 (GB) ..... 1110535.0

(51) Int. Cl.
*B05B 1/18* (2006.01)
*B05B 7/10* (2006.01)
(Continued)

(52) U.S. Cl.
CPC ..... *B05B 1/185* (2013.01); *B05B 1/06* (2013.01); *B05B 7/0433* (2013.01);
(Continued)

(58) Field of Classification Search
CPC .. B05B 1/06; B05B 1/18; B05B 1/185; B05B 1/3426; B05B 1/3463; B05B 1/3421;
(Continued)

(56) References Cited

U.S. PATENT DOCUMENTS 2,458,220 A * 1/1949 Striegel ..... B05B 7/0846 239/305
3,945,574 A * 3/1976 Polnauer et al. ..... 239/404
(Continued)

FOREIGN PATENT DOCUMENTS

CN 201313083 Y 9/2009
DE 198131366 10/1998
(Continued)

OTHER PUBLICATIONS

International Search Report, International Application No. PCT/GB2012/051436, Completed Nov. 13, 2012, Mailed Nov. 23, 2012, Authorized Officer Maria Chiara Frego, European Patent Office.
(Continued)

*Primary Examiner* — Arthur O Hall
*Assistant Examiner* — Cody Lieuwen
(74) *Attorney, Agent, or Firm* — Fay Sharpe LLP

(57) ABSTRACT

A shower head (10C) has at least one mixing chamber (24) having an air inlet (18) for connection to a supply of pressurized air and a water inlet (22) for connection to a supply of pressurized water so that, in use, the air breaks the water up into droplets in the mixing chamber. The mixing chamber further has at least one outlet (32) so that, in use, the water droplets and air exit the shower head to form a shower of water droplets having a mean trajectory. The or each outlet is arranged so that, in use, at least a substantial proportion of the water droplets exit the shower head so that their individual trajectories on leaving the shower head are offset from the mean trajectory of the shower head and
(Continued)

converge towards the mean trajectory of the shower head. This can result in a more uniform distribution of water droplets in the shower pattern. A single annular outlet may be provided, or a plurality of separate outlets. In order to assist in breaking up the water into small droplets, a vortex may be induced in the air and/or the water in the mixing chamber, and/or a deflector may be disposed adjacent the water inlet into the mixing chamber.

15 Claims, 6 Drawing Sheets

(51) Int. Cl.
*B05B 1/06* (2006.01)
*B05B 7/04* (2006.01)
*B05B 15/06* (2006.01)
*B05B 1/34* (2006.01)

(52) U.S. Cl.
CPC ..... *B05B 7/0466* (2013.01); *B05B 7/10* (2013.01); *B05B 15/066* (2013.01); *B05B 1/18* (2013.01); *B05B 1/3405* (2013.01)

(58) Field of Classification Search
CPC ..... B05B 1/3415; B05B 1/341; B05B 1/3405; B05B 3/026; B05B 3/025; B05B 7/0433; B05B 7/0441; B05B 7/045; B05B 7/0458; B05B 7/0466; B05B 7/0475; B05B 7/0483; B05B 7/0807; B05B 7/0846; B05B 15/066; B05B 15/067; B05B 1/14; B05B 1/26; A61H 33/027
USPC ..... 239/587.1–587.6, 588, 552–561, 239/566–568, 536, 399, 402–404, 543, 239/544, 478, 479, 398, 406, 416.5, 239/417.5, 432–434, 467, 473, 476, 489, 239/490–491, 311, 369, 419, 420, 426
See application file for complete search history.

(56) References Cited

U.S. PATENT DOCUMENTS

| | | | | |
|---|---|---|---|---|
| 3,965,494 | A * | 6/1976 | Baker | 4/615 |
| 4,426,040 | A | 1/1984 | Smith | |
| 5,143,295 | A * | 9/1992 | Okayama et al. | 239/403 |
| 5,918,811 | A * | 7/1999 | Denham et al. | 239/123 |
| 6,098,896 | A * | 8/2000 | Haruch | B01J 8/1827 239/432 |
| 7,055,767 | B1 * | 6/2006 | Ko | 239/587.4 |
| 7,356,857 | B2 * | 4/2008 | Rosenberg | A47K 3/28 239/536 |
| 8,016,215 | B1 * | 9/2011 | Zhadanov et al. | 239/544 |
| 2007/0246577 | A1 * | 10/2007 | Leber | 239/589 |
| 2009/0166448 | A1 * | 7/2009 | Wurz et al. | 239/398 |
| 2010/0252658 | A1 * | 10/2010 | Honeyands | 239/398 |

FOREIGN PATENT DOCUMENTS

| | | | | |
|---|---|---|---|---|
| DE | 202011001711 | U1 | 4/2011 | |
| GB | 2476804 | A * | 7/2011 | B05B 1/18 |
| JP | H09262512 | A | 10/1997 | |
| JP | 2001149252 | A | 6/2001 | |
| JP | 2007326082 | A | 12/2007 | |
| WO | WO2009/056887 | A1 | 5/2009 | |
| WO | WO2011/054121 | A2 | 5/2011 | |
| WO | WO2012/175966 | A1 | 12/2012 | |

OTHER PUBLICATIONS

Written Opinion, of the International Searching Authority, International Application No. PCT/GB2012/051436, Completed Nov. 13, 2012, Mailed Nov. 23, 2012, Authorized Officer Maria Chiara Frego, European Patent Office.
British Search Report, GB1110535.0, Date of Search Sep. 12, 2011, 1 pg.
British Search Report, GB1110533.5, Date of Search Sep. 12, 2011, 1 pg.

* cited by examiner

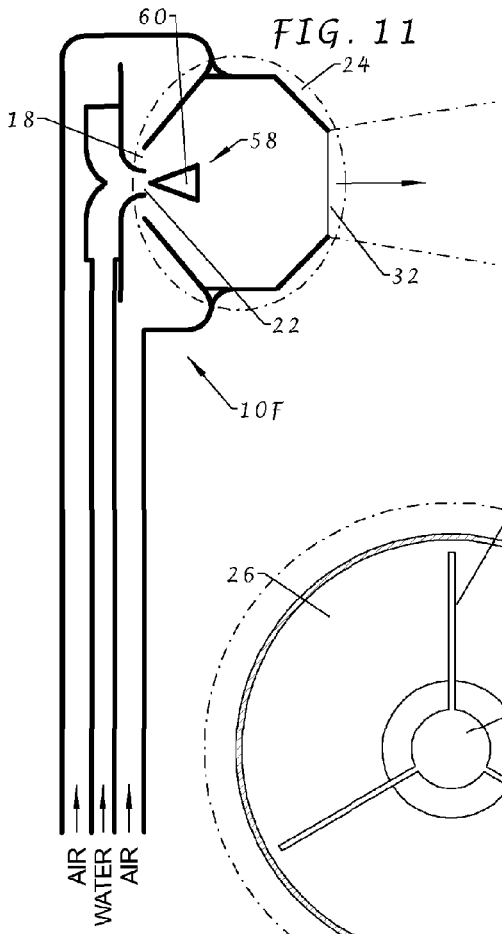
FIG. 11
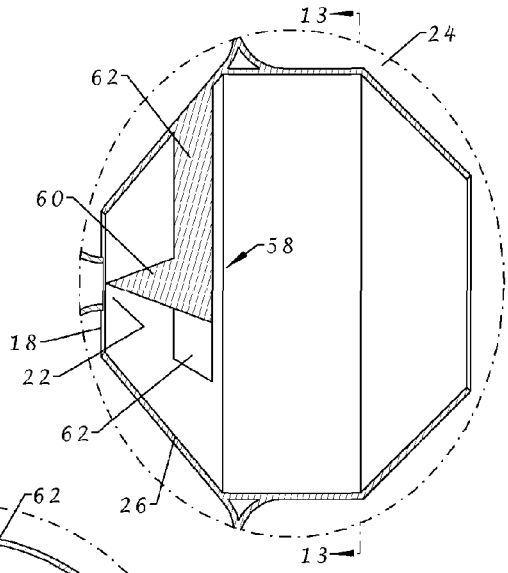
FIG. 12
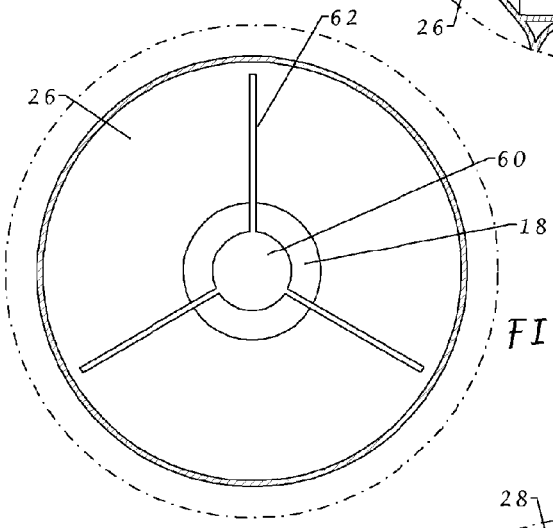
FIG. 13
FIG. 15
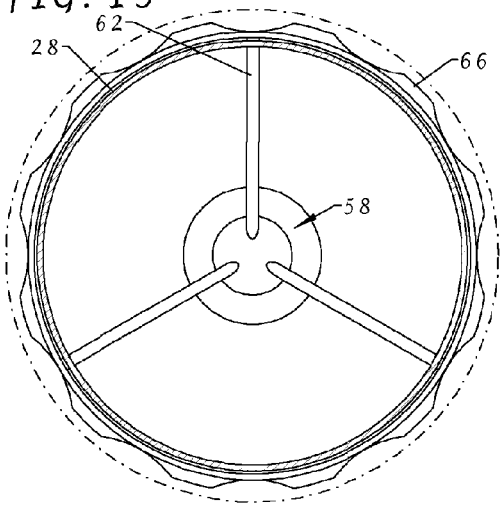
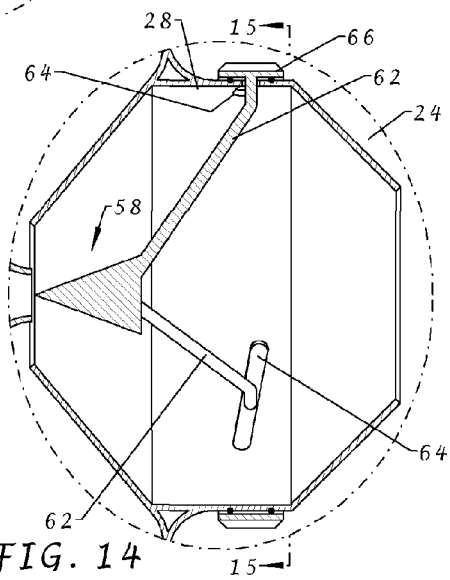
FIG. 14

SHOWER HEADS AND SHOWER APPARATUS

CROSS REFERENCE TO RELATED APPLICATIONS

This application is a 371 National Stage Entry of International application number PCT/GB2012/051436, having an international filing date of Jun. 21, 2012, which was published in English, and which claims priority to Great Britain Patent Application No. GB 1110535.0, filed Jun. 22, 2011 and GB1110535.5, filed Jun. 22, 2011, the entirety of which are hereby incorporated by reference as if fully set forth herein.

This invention relates to shower heads and to shower apparatus having such shower heads.

It is well known that showering uses less water, and therefore less energy to heat the water, than bathing. Nevertheless, there are concerns about the amount of water and energy used when showering. For example, in an attempt to reduce water and energy usage, federal regulations were introduced in the USA in 1992 limiting shower head flow rate to 2.5 US gallons of water per minute (about 9.5 liters per minute), and some cities are already imposing tighter regulations. However, many people find that such a low flow rate does not provide them with a shower that feels sufficiently powerful. As reported in an article in the online Wall Street Journal dated 13 Nov. 2009, consumers often remove the flow restrictor in the shower head to increase the flow rate (and indeed the packaging provided with some shower heads includes details of how to do this). Alternatively or additionally, they install more than one shower head in their shower cubicle.

It is known that the apparent power of a shower can be improved by mixing air with the water, for example by providing a turbine in the shower head, or by forcing the water through a Venturi which draws air into the water flow.

It is also known from patent document WO2009/056887A1 (Rapro Emulations) that the apparent power of a shower can be further improved by pumping air at a relatively high flow rate to the shower head and mixing the air with water in a mixing chamber so that the water is broken up into droplets before exiting the mixing chamber through an outlet so as to form a shower of droplets.

A development of the type of shower head disclosed in WO2009/056887A1 is shown schematically in FIG. 1 of the accompanying drawings. The shower head 10A has a tubular handle 12 at one end of which air is introduced from a compressor (not shown). A smaller diameter tube 14 extends along the handle and is connected to a supply of pressurised water (not shown). At the other end of the handle 12, the air flows past the edge of a circular plate 15 into an annular air chamber 16. The annular chamber 16 has an outlet 18 at its centre, and the thickness of the annular chamber 16 decreases towards its centre. The water flows to a thin cylindrical water chamber 20 behind the plate 15 and exits through an outlet 22 at the centre of the plate 15 and surrounded by the air outlet 18, which is therefore annular. The air and water flow from the outlets 18,22 into a mixing chamber 24 having a divergent section 26, a cylindrical section 28 and a convergent nozzle section 30 leading to an outlet 32 of the shower head 10A. It will be appreciated that the annular chamber 16, the air outlet 18 and the divergent section 26 of the mixing chamber 24 form a convergent section, throat and divergent section, respectively, of a Venturi. At the annular air outlet 18 (throat), the air has relatively high speed and low pressure. As the air expands in the divergent section 26 of the mixing chamber 24, it breaks the water up into droplets. The cylindrical section 28 and the nozzle section 30 of the mixing chamber 24 shape the flow of water droplets and air before they exit through the shower outlet 32 as a shower 34 of droplets.

In the shower head 10A described above, the annular air chamber 16, the water chamber 20, the air and water outlets 18,22, the divergent, cylindrical and nozzle sections 26,28, 30 of the mixing chamber 24 and the shower outlet 32 are all coaxial on axis 36. Ignoring the effects of gravity, the shower 34 of droplets is therefore substantially symmetrical around the axis 36 and the mean trajectory 37 of the shower 34 of droplets is along the axis 36. Furthermore, again ignoring the effects of gravity, at the least the majority of droplets in the shower 34 each has an individual trajectory which is either along the axis 36 or diverges from the axis 36.

In the remainder of this specification (including the claims), any references to the trajectories of the shower and of individual droplets are intended to be understood as ignoring the effects of gravity.

It has been found that, with the shower head 10A described above, there is some non-uniformity in the distribution of water droplets across the shower pattern. Notably, nearer the axis 36, the droplets tend to be larger, whereas at the edge of the shower pattern the droplets are smaller and form a mist. It is also to be noted that, with the shower head described above, for particular water and air flow rates, there is no provision for adjustment of the shower pattern or droplet size.

An aim of the present invention, or at least of specific embodiments of it, is to enable a more uniform distribution of droplets in the shower pattern and to enable the shower pattern and droplet size to be adjusted.

In accordance with a first aspect of the present invention, there is provided a shower head having: at least one mixing chamber having an air inlet for connection to a supply of pressurised air and a water inlet for connection to a supply of pressurised water so that, in use, the air breaks the water up into droplets in the mixing chamber, the mixing chamber further having at least one outlet so that, in use, the water droplets and air exit the shower head to form a shower of water droplets having a mean trajectory. The shower head is characterised in that the or each outlet is arranged so that, in use, at least a substantial proportion of the water droplets exit the shower head so that their individual trajectories on leaving the shower head are offset from the mean trajectory of the shower head and converge towards the mean trajectory of the shower head. This can result in a more uniform distribution of water droplets in the shower pattern.

In one embodiment, the shower head has a single such mixing chamber and a single such outlet, and the outlet is annular having an axis substantially coaxial with the mean trajectory of the shower head. The annular outlet is preferably defined between an inner lip and an outer lip, with the relative positions of the inner and outer lips being adjustable in the direction of the mean trajectory of the shower head so as to vary the shower pattern. The inner lip may be provided by a substantially conical member having its apex pointing towards the air and water inlets.

In an alternative embodiment, the shower head has a plurality of such outlets arranged around the mean trajectory of the shower head such that the mean trajectory of water droplets exiting each outlet converges towards the mean trajectory of the shower head. The number of the outlets is preferably at least three. However, the number of the outlets is preferably not excessively large, for example no more than six, so as not to produce excessive energy losses at the outlets. The angle of convergence between the mean trajectory of each outlet and the mean trajectory of the shower head is preferably adjustable so as to vary the shower pattern. In one form of this embodiment, the shower head has a single mixing chamber for supplying all of the outlets, whereas in another form, each of the outlets has a respective mixing chamber.

The shower head is preferably arranged to cause the air to form an air vortex in the mixing chamber. Such an air vortex assists in dispersing the water in the mixing chamber and results in smaller sized droplets.

This latter feature may be provided independently of some of the other features of the first aspect of the invention. Therefore, in accordance with a second aspect of the present invention, there is provided a shower head having a mixing chamber having an air inlet for connection to a supply of pressurised air and a water inlet for connection to a supply of pressurised water so that, in use, the air breaks the water up into droplets in the mixing chamber. The mixing chamber further has an outlet so that, in use, the water droplets and air exit the shower head to form a shower of water droplets. The invention characterised in that the shower head is arranged to cause the air to form an air vortex in the mixing chamber. Again, such an air vortex assists in dispersing the water in the mixing chamber and results in smaller sized droplets.

In a preferred embodiment, the air inlet to the mixing chamber is fed by an air feed chamber.

The air feed chamber may have at least one inclined vane for forming an air vortex in the air feed chamber and thence for forming the air vortex in the mixing chamber.

Additionally or alternatively, the air feed chamber may be fed by an air inlet that is asymmetrically disposed with respect to the air feed chamber to cause a vortex to form in the air feed chamber and thence for forming the air vortex in the mixing chamber.

Means are preferably provided for adjusting the strength of the air vortex in the mixing chamber. For example, the means for adjusting the strength of the air vortex may be arranged to change the angle of inclination of the inclined vane(s). Additionally or alternatively, the mixing chamber may have a second air inlet for connection to the supply of pressurised air; with the second air inlet being arranged to cause the air not to form a vortex in the mixing chamber, or to cause a vortex in the mixing chamber of less strength than the first-mentioned air inlet. In this case, the vortex strength adjusting means preferably comprises means for adjusting the relative proportions of air entering the mixing chamber via the first and second air inlets.

The shower head may be arranged to cause the water to form a water vortex in the mixing chamber. Such a water vortex assists in dispersing the water in the mixing chamber and results in smaller sized droplets.

This latter feature may be provided independently of some of the other features of the other aspects of the invention. Therefore, in accordance with a third aspect of the present invention, there is provided a shower head having: a mixing chamber having an air inlet for connection to a supply of pressurised air and a water inlet for connection to a supply of pressurised water so that, in use, the air breaks the water up into droplets in the mixing chamber; the mixing chamber further having an outlet so that, in use, the water droplets and air exit the shower head to form a shower of water droplets; wherein the shower head is arranged to cause the water to form a water vortex in the mixing chamber. Again, such a water vortex assists in dispersing the water in the mixing chamber and results in smaller sized droplets.

The water inlet to the mixing chamber is preferably fed by a water feed chamber. The water feed chamber may have at least one inclined vane for forming a water vortex in the water feed chamber and thence for forming the water vortex in the mixing chamber. Additionally or alternatively, the water feed chamber may be fed by a water inlet that is asymmetrically disposed with respect to the water feed chamber to cause a water vortex to form in the water feed chamber and thence for forming the water vortex in the mixing chamber.

In the case where the shower head is arranged to cause both the air vortex and the water vortex in the mixing chamber, the vortices preferably to rotate in the same direction.

A deflector may be disposed in the or each mixing chamber in alignment with the water inlet so that, in use, water impinges on the deflector in the mixing chamber. The deflector results in increased break up of the water and smaller sized droplets.

Such a deflector may be provided independently of some of the features of the other aspects of the invention. Therefore, in accordance with a fourth aspect of the present invention, there is provided a shower head having a mixing chamber having an air inlet for connection to a supply of pressurised air and a water inlet for connection to a supply of pressurised water so that, in use, the air breaks the water up into droplets in the mixing chamber. The mixing chamber further has an outlet so that, in use, the water droplets and air exit the shower head to form a shower of water droplets. The invention is characterised in that a deflector disposed in the or each mixing chamber in alignment with the water inlet so that, in use, water impinges on the deflector in the mixing chamber. The deflector results in increased break up of the water and smaller sized droplets.

In one embodiment, the position of the deflector relative to the water inlet is adjustable, so that the size of the water droplets can be adjusted.

The deflector preferably has a pointed end pointing towards the water inlet and is preferably substantially conical having its apex pointing towards the water inlet.

The air and water inlets of the or each mixing chamber are preferably grouped together at one end of the mixing chamber; and the outlet(s) of the or each mixing chamber are preferably disposed at an opposite end of that mixing chamber.

The air inlet to the mixing chamber preferably surrounds the water inlet.

The or each mixing chamber preferably has a divergent portion extending from the air and water inlets in a direction towards the outlet(s). The or each mixing chamber has a convergent portion extending from the divergent portion towards the or each outlet.

The air inlet has a convergent inlet tract leading to the air inlet. The convergent inlet tract and the divergent portion of the mixing chamber form a Venturi.

The mixing chamber is preferably provided at one end of a handle of the shower head, with the other end of the handle having means for connecting the shower head to a supply of pressurised water and a supply of pressurised air, and with the handle having passageways for conveying water and air from the connecting means to the water inlet(s) and the air inlet(s).

In accordance with a fifth aspect of the present invention, there is provided a shower apparatus comprising: a shower head according to any of the first to fourth aspects of the invention; a supply of pressurised water connected to the water inlet of the shower head; and an air compressor connected to the air inlet of the shower head.

Specific embodiments of the present invention will now be described, purely by way of example, with reference to the accompanying drawings, in which.

Figure 5A:
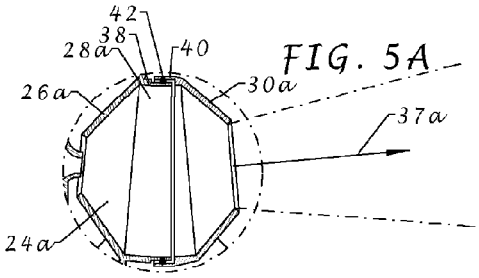
Figure 4:
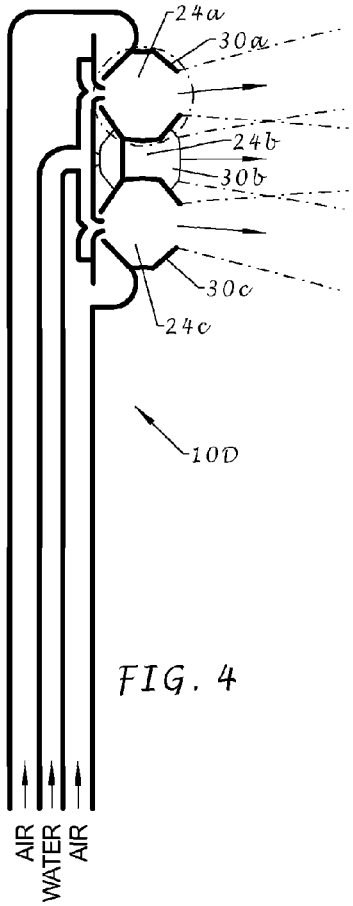
FIG. 4 is a schematic sectioned side view of a shower head 10D with multiple adjustable nozzles having individual mixing chambers.
Figure 6:
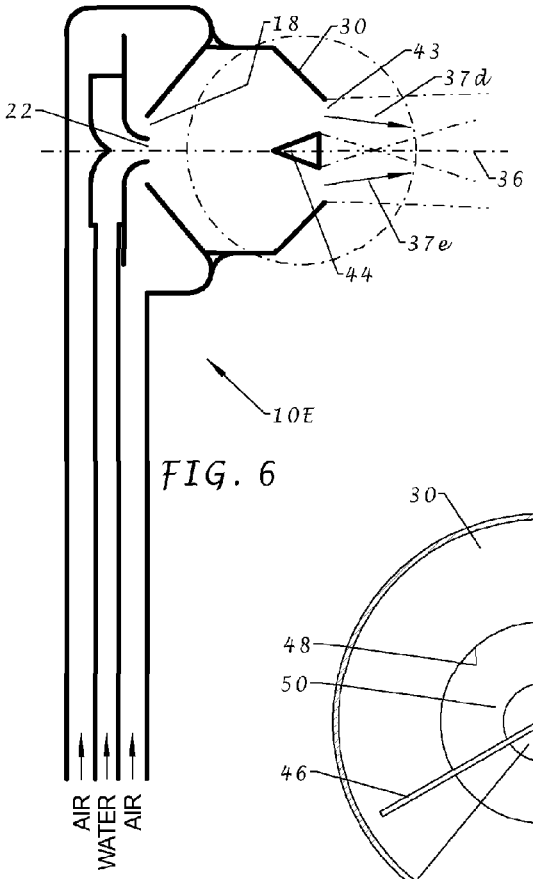
Figure 7:
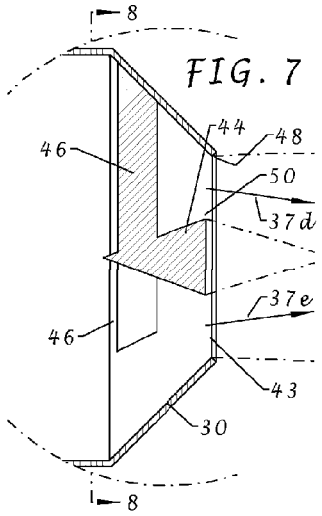
Figure 8:
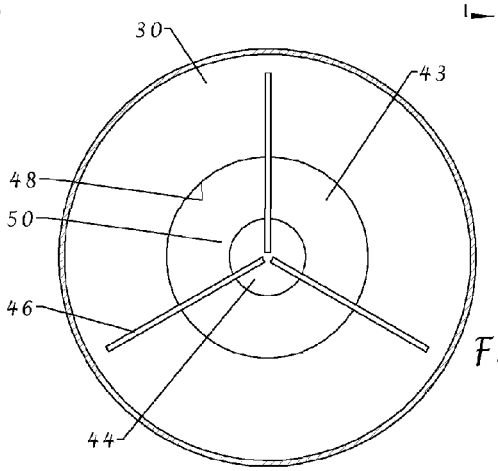
Figure 9:
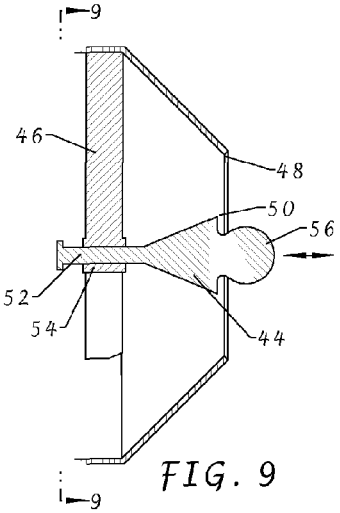
Figure 10:
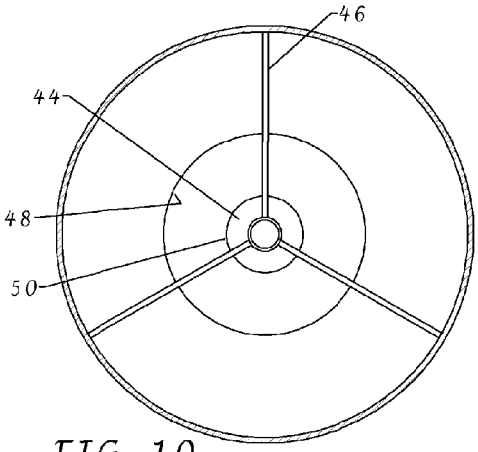
Figure 16A:
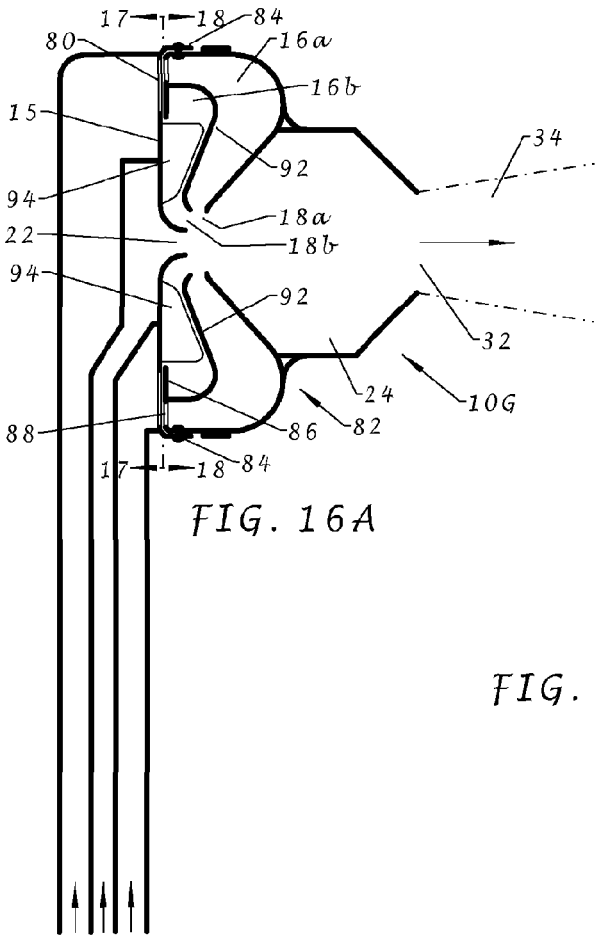
Figure 17:
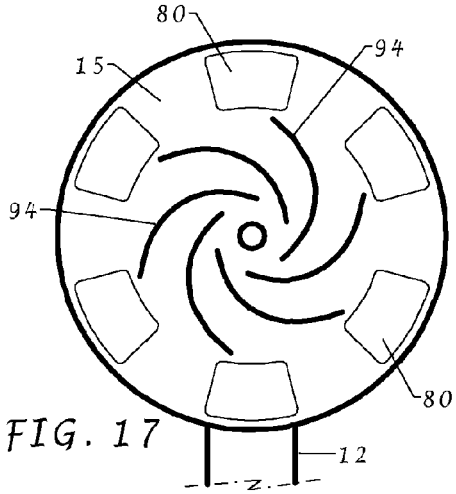
Figure 18A:
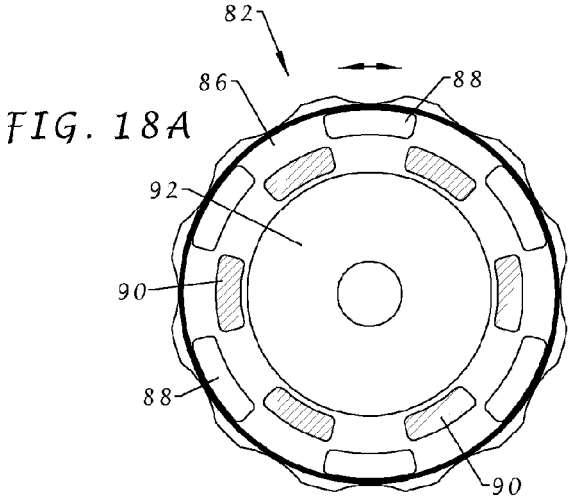
Figure 18B:
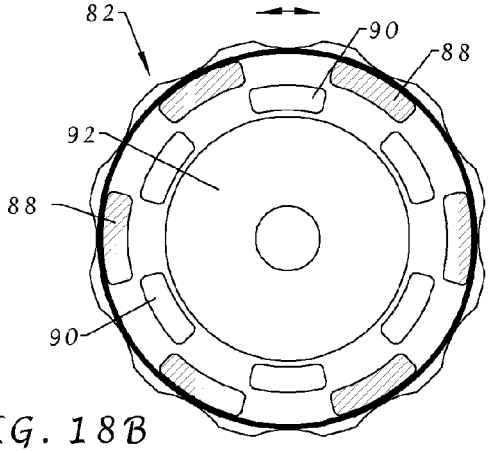
Figure 18C:
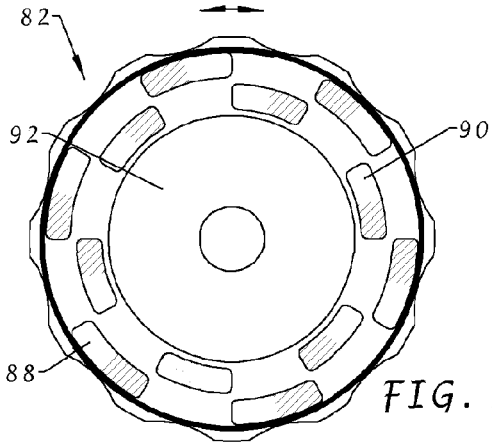
Figure 19:
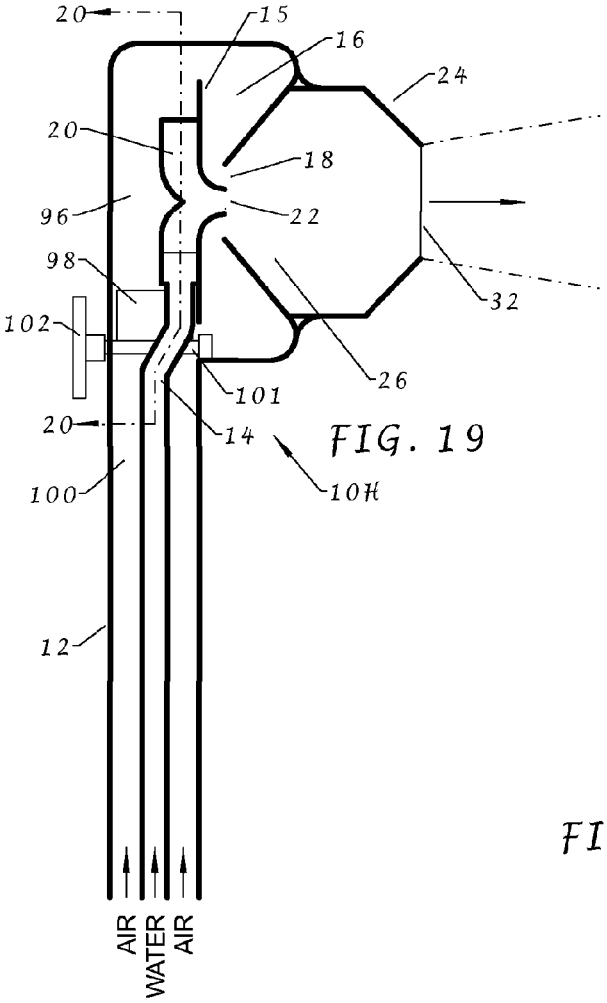
Figure 20:
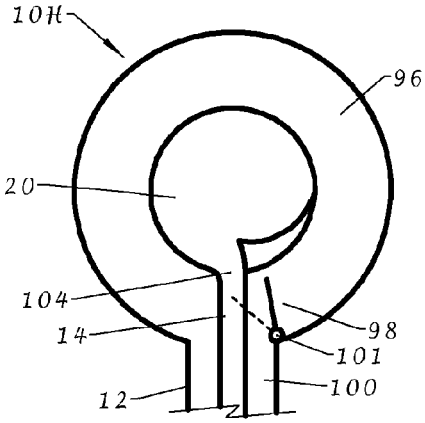
Figure 21:
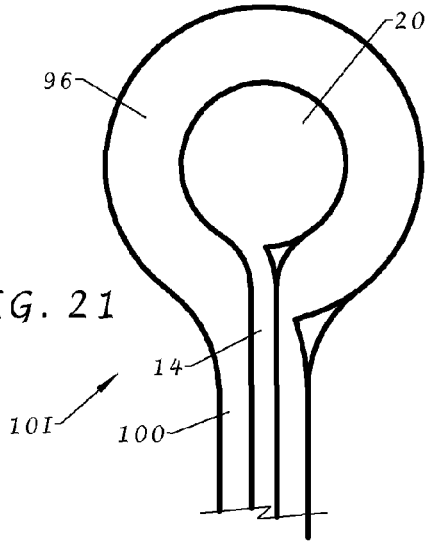

FIGS. 5A & B show, on an enlarged scale, the portion of FIG. 4 that is enclosed by a dash-dot circle, with the nozzle in two different positions of adjustment;

FIG. 6 is a schematic sectioned side view of a shower head 10E with an annular nozzle;

FIG. 7 shows, on a larger scale, the portion of FIG. 6 that is enclosed by a dash-dot circle;

FIG. 8 is a sectioned view taken on the section line 8-8 shown in FIG. 7;

FIGS. 9 & 10 are similar to FIGS. 7 and 8, respectively, but showing an adjustable annular nozzle;

FIG. 11 is a schematic sectioned side view of a shower head 10F with a deflector adjacent the water outlet;

FIG. 12 shows, on a larger scale, the portion of FIG. 11 that is enclosed by a dash-dot ellipse;

FIG. 13 is a sectioned view taken on the section line 13-13 shown in FIG. 12;

FIGS. 14 & 15 are similar to FIGS. 12 and 13, respectively, but showing an adjustable deflector;

FIGS. 16A & B are schematic sectioned side view of a shower head 10G which can induce an air vortex in the mixing chamber, the shower head being shown in two different positions of adjustment;

FIG. 17 is a view of one part of the shower head 10G as seen in the direction of the arrows 17-17 shown in FIG. 16A; and FIGS. 18A-C are views of another part, in three different positions respectively, of the shower head 10G as seen in the direction of the arrows 18-18 shown in FIG. 16A FIG. 19 is a schematic sectioned side view of a shower head 10H which can induce both an air vortex and a water vortex in the mixing chamber;

FIG. 20 is a sectioned view of the shower head 10H taken on the section line 20-20 shown in FIG. 19; and FIG. 21 is similar to FIG. 20, but showing a modified shower head 10I which can induce both an air vortex and a water vortex in the mixing chamber.

In the following description, the shower heads 10B-I are developments of the shower head 10A described above with reference to FIG. 1 and possess similar features unless otherwise stated.

Figure 1:
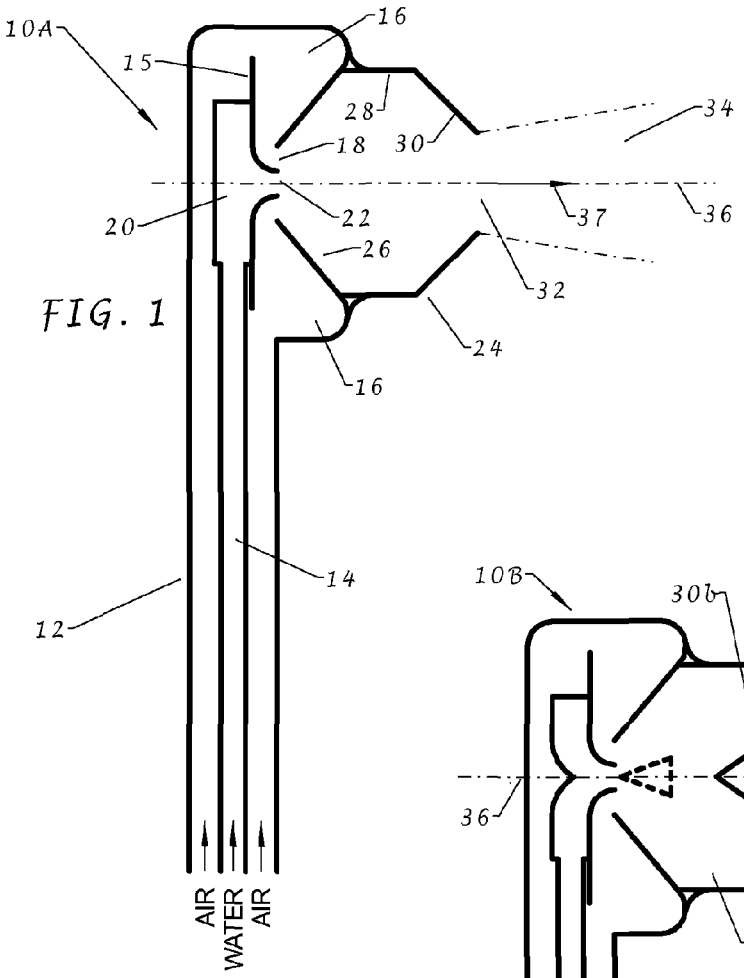
FIG. 1 is a schematic sectioned side view of a shower head 10A which is a development of the shower head disclosed in patent document WO2009/056887A1.
Figure 2:
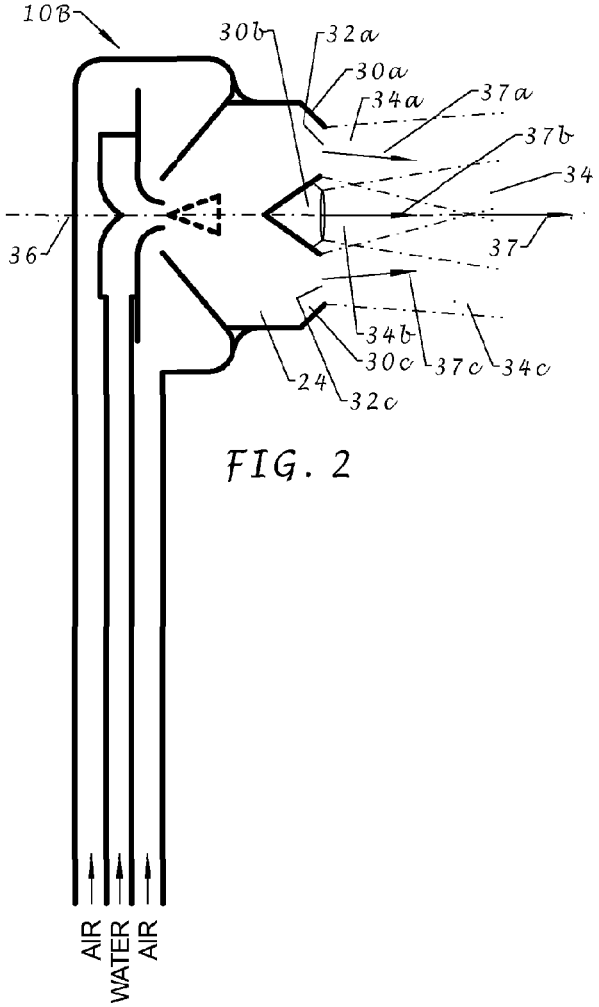
FIG. 2 is a schematic sectioned side view of a shower head 10B with multiple fixed nozzles and a common mixing chamber.

Referring to FIG. 2, the mixing chamber 24 of the shower head 10B does not have a single convergent nozzle section 30, but instead has four convergent nozzle sections arranged at the corners of a square around the axis 36. Only three of the convergent nozzle sections 30*a-c* can be seen in FIG. 2. The water droplets therefore exit the shower head 10B as four separate showers 34*a-c* of droplets (only three of which are shown in FIG. 2). The nozzle sections 30*a-c* are configured and oriented so that the mean trajectories 37*a-c* of their individual showers 34*a-c* converge towards the central axis 36. The individual showers 34*a-c* therefore amalgamate shortly after the leaving the four shower outlets 32*a-c* into a single shower 34 having a mean trajectory 37 coaxial with the central axis 36. It has been found that, some distance from the shower head, the single shower 34 has a more uniform shower pattern than with the shower head of FIG. 1, in that the droplet density and droplet sizes are more uniform and there is less misting at the bounds of the shower.

Figure 3:
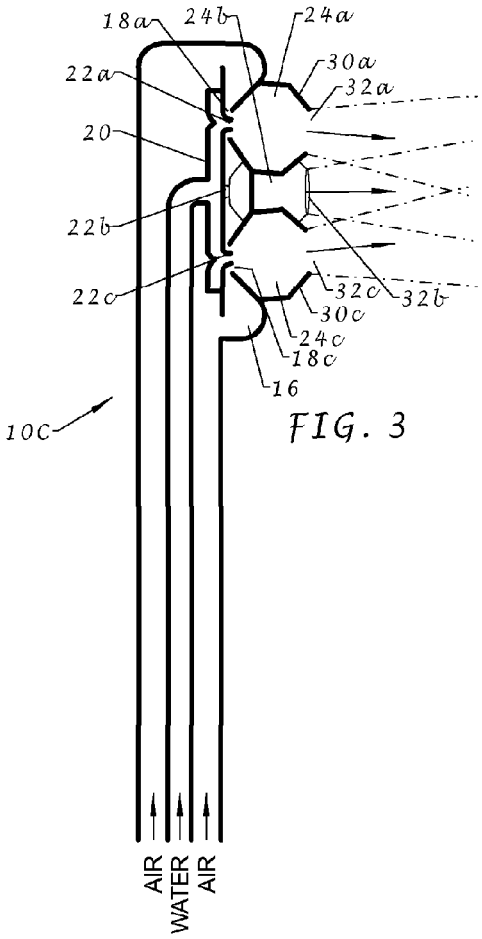
FIG. 3 is a schematic sectioned side view of a shower head 10C with multiple fixed nozzles having individual mixing chambers.

Referring now to FIG. 3, the shower head 10C does not have a single mixing chamber 24, but instead has four symmetrically-arranged mixing chambers 24*a-c* (only three of which can be seen in FIG. 3) each fed by a respective water outlet 22*a-c* from the water chamber 20. Also, the air chamber 16 is arranged to provide four air outlets 18*a-c* into the respective mixing chambers 24*a-c*. The convergent nozzle sections 30*a-c* and outlets 32*a-c* of the four mixing chambers 24*a-c* are arranged similarly to the nozzle sections 30*a-c* and outlets 32*a-c* of the shower head 10B of FIG. 2 and produce a similar effect.

Figure 5B:
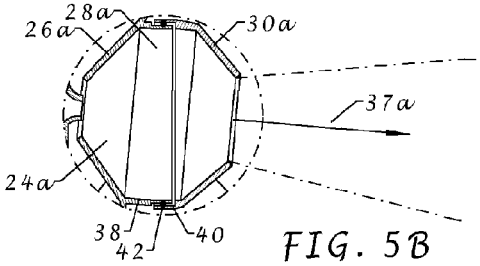

Referring now to FIGS. 4 to 5B, the shower head 10D is similar to the shower head 10C of FIG. 3, except that the four convergent nozzle sections 30*a-c* are adjustable. In particular, as shown in FIGS. 5A & B, the cylindrical section (28*a* being shown in the drawings) of each mixing chamber (24*a* being shown) is divided into two overlapping portions 38,40 having an O-ring seal 42 therebetween. Each O-ring 42 lies in a plane which is not at right angles to the axis of the respective divergent section 26*a-c*. Each convergent nozzle section 30*a-c* can therefore be rotated relative to its divergent section 26*a-c* so as to vary the inclination of the mean trajectory 37*a-c* of the shower exiting from each nozzle section 30*a-c*.

The nozzle sections 30*a-c* may be individually adjustable, as shown in the drawings, or they may be mechanically linked, for example by a central pinion or by a surrounding ring gear (not shown) so that the nozzle sections 30*a-c* are adjusted in synchronism.

Referring now to FIGS. 6 to 8, the shower head 10E differs from the shower head 10A of FIG. 1 in that the shower outlet 43 is annular instead of circular. The outlet 43 is rendered annular by a conical member 44 which is supported within the shower outlet 43 by three thin radial webs 46 connected to the convergent nozzle section 30, with the apex of the conical member pointing towards the water outlet 22. The annular outlet 43 is therefore formed between an outer lip 48 provided by the smaller end of the convergent nozzle section 30 and an inner lip 50 provided by the base edge of the conical member 44.

The inner lip 50 may be offset from the outer lip 48 along the axis 36 so as to achieve a desired shower pattern so that the mean trajectory 37*d* of water droplets exiting from one side of the annular outlet 43 is oppositely inclined and converges towards the mean trajectory 37*e* of water droplets exiting from the opposite side of the annular outlet 43. An optimum amount of offset may be ascertained by trial and error during the design stage. Alternatively, as shown in FIGS. 9 and 10, the axial offset between the inner lip 50 and the outer lip 48 may be adjustable, for example by means of a pin 52 projecting from the apex of the conical member 44 and frictionally slidable in a boss 54 at the centre of the mounting webs 46. A manually graspable knob 56 may be provided at the base of the conical member 44 to assist adjustment.

Referring now to FIGS. 11 to 13, the shower head 10F differs from the shower head 10A of FIG. 1 in that a deflector 58 is positioned adjacent the water outlet 22. As shown in particular in FIGS. 12 and 13, the water deflector 58 comprises a conical member 60 mounted, with its apex facing the water outlet 22, by three thin radial webs 62 connected to the divergent section 26 of the mixing chamber 24. The water deflector 58 acts to split up the jet of water exiting from the water outlet 22 so that the water can be more readily be formed into droplets by the air flow from the air outlet 18.

The apex of the conical member 60 may be spaced a short distance from the water outlet 22 or may protrude by a short distance into the water outlet 22. An optimum position of the conical member 60 may be ascertained by trial and error during the design stage. Alternatively, as shown in FIGS. 14 and 15, the axial position of the water deflector 58 may be adjustable, for example by means of the outer ends of the mounting webs or rods 62 passing through inclined slots 64 in the cylindrical section 28 of the mixing chamber 24 and being connected to an adjustment collar 66 which is rotatable around the cylindrical section 28 of the mixing chamber 24.

Referring now to FIGS. 16 to 18, the shower head 10G differs from the shower head 10A of FIG. 1 in that the shower head 10G has a pair of air chambers 16*a,b*, one of which promotes a vortex in the mixing chamber 24, and the strength of the vortex is adjustable. Unlike the shower head 10A of FIG. 1, in the shower head 10G the air passes through a circular array of apertures 80 in the plate 15 rather than passing over the outer edge of the plate 15. The air chambers 16*a,b* and the mixing chamber 24 are formed by a separate part 82 which is rotatably and sealing mounted in a lip 84 at the periphery of the plate 15. The part 82 has an flat annular wall 86 formed with an outer circular array of apertures 88 and an inner circular array of apertures 90 which are angularly staggered with respect to the apertures 88. The air chamber is divided into two 16A,B by a shaped annular dividing wall 92 connected to the flat annular wall 86 between the outer apertures 88 and the inner apertures 90. At the inner edge of the dividing wall 92, a pair of air outlets 18*a,b* are formed. A circular array of scrolled deflector vanes 94 are formed on the plate 15 and protrude into the air chamber 16*a*.

In some angular positions of the part 82 relative to the remainder of the shower head 10G, as shown in FIGS. 16A and 18A, each of the outer apertures 88 in the wall 86 is aligned with a respective one of the apertures 80 in the plate 15 so that air can flow into the air chamber 16*a* and exit through the outlet 18*a* into the mixing chamber 24 in a similar way to the shower head 10A of FIG. 1. However, each of the inner apertures 90 in the wall 86 is blocked by the plate 15, as shown by hatching in FIG. 18A, so that substantially no air flows through the air chamber 16*b*.

Figure 16B:
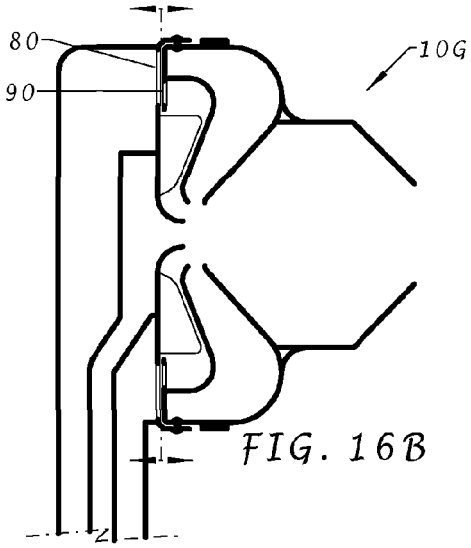

In other angular positions of the part 82 relative to the remainder of the shower head 10G, as shown in FIGS. 16B and 18B, each of the outer apertures 88 in the wall 86 is blocked by the plate 15, as shown by hatching in FIG. 18B, so that substantially no air flows through the air chamber 16*a*. However, each of the inner apertures 90 in the wall 86 is aligned with a respective one of the apertures 80 in the plate 15 so that air can flow into the air chamber 16*b* and exit through the outlet 18*b* into the mixing chamber 24. In passing through the air chamber 16*b*, the scrolled deflector vanes 94 induce a vortex in the air flow, and it has been found that such a vortex causes the droplets in the shower 34 to have a smaller droplet size.

In intermediate angular positions of the part 82 relative to the remainder of the shower head 10G, as shown in FIG. 18C, each of the outer and inner apertures 88,90 in the wall 86 is partly blocked by the plate 15, as shown by hatching in FIG. 18C, so that a proportion of the air flow, dependent on the angular position of the part 82, passes through the chamber 16*b* where a vortex is induced in the air flow, while the remainder of the air flows through the air chamber 16*a* without a vortex being induced. When the air flows merge after the air outlets 18*a,b*, a vortex of reduced strength is results in the mixing chamber 24. It will therefore be appreciated that the strength of the vortex and therefore the size of the droplets in the shower 34 can be adjusted by manually rotating the part.

Referring now to FIGS. 19 and 20, the shower head 10H differs from the shower head 10A of FIG. 1 in that, in the air chamber 96 behind the circular plate 15, an inclined vane 98 is disposed to one side of the downstream end of the air passageway 100 through the handle 12. The vane 98 causes a vortex to be formed in the air in the chamber 96, which, as viewed in FIG. 20, rotates clockwise. As the air proceeds through the air chamber 16 (convergent portion of the Venturi), air outlet 18 (throat portion of the Venturi) and divergent section 26 of the mixing chamber 24, the air continues to rotate. The effect of the air vortex in the divergent section 26 of the mixing chamber 24 is to throw the water radially outwards and break it up into smaller droplets. The vortex inducing vane 98 may be fixed, or as shown in the drawings the vane 98 may be mounted on a shaft 101 supported in friction bushes (not shown) and rotationally adjustable by a knob 102 so that the angle of inclination of the vane 98 is adjustable to adjust the strength of the air vortex. If need be, the vane 98 may notched so that it does not foul the downstream end of the water tube 14.

The shower head 10H of FIGS. 19 and 20 also differs from the shower head 10A of FIG. 1 in that the internal radius of the water chamber 20 decreases to one side of the inlet 104 from the water tube 14 compared to the other side of the inlet 104, as most clearly shown in FIG. 20. This causes a vortex to be formed in the water in the chamber 20, which, as viewed in FIG. 20, rotates clockwise. As the water proceeds through the water outlet 22 and divergent section 26 of the mixing chamber 24, the water continues to rotate. The effect of the water vortex in the divergent section 26 of the mixing chamber 24 is, again, to throw the water radially outwards and break it up into smaller droplets.

The air and water vortices may be arranged to be contra-rotating, but as shown by the drawings they preferably rotate in the same direction.

The shower head 10I of FIG. 21 is similar to the shower head 10H of FIGS. 19 and 20 except that, in order to induce the air and water vortices, the downstream ends of the air passageway 100 and water tube 14 are inclined so as to provide tangential components to the air and water flows upon entry into the air chamber 96 and water chamber 20 respectively. It will be appreciated that other methods of inducing the air and water vortices may be employed.

The various features of the shower heads 10B-I described above may be combined in various combinations in a single shower head so as to form alternative embodiments of the invention.

It should be noted that the embodiments of the invention has been described above purely by way of example and that many modifications and developments may be made thereto within the scope of the present invention.

The invention claimed is:

1. A shower head including:

a housing;

a plurality of mixing chambers arranged at least partially within the housing, each mixing chamber having:

a divergent portion, a convergent nozzle portion downstream of the divergent portion, an outlet downstream of the convergent nozzle portion, an air inlet for connection to a supply of pressurised air, and a water inlet for connection to a supply of pressurised water;

each mixing chamber being arranged so that, in use, the air breaks the water up within the mixing chamber into water droplets distributed in the air, whereby the water droplets distributed in the air flow through the divergent portion and convergent nozzle portion of the mixing chamber;

the outlets being arranged so that, in use, the water droplets exit the shower head distributed in the flowing air via the outlets as a plurality of individual showers of said water droplets which were formed within the mixing chambers, each individual shower of water droplets being emitted from a respective one of the mixing chambers, each water droplet having an individual trajectory, a mean of said individual trajectories defining a mean trajectory of the shower head;

wherein the outlets are arranged around the mean trajectory of the shower head, each outlet having a respective outlet emission axis extending from the respective mixing chamber, the outlet emission axis of each outlet being defined by a mean trajectory of the individual shower of water droplets emitted in use from the respective outlet;

and the outlet emission axes are offset from the mean trajectory of the shower head;

and the mixing chambers are configured so that the outlet emission axes converge towards the mean trajectory of the shower head, whereby the individual showers of droplets emitted from all of the outlets are combined to form a single shower of droplets along the mean trajectory of the shower head.

2. A shower head as claimed in claim 1, including at least three outlets.

3. A shower head as claimed in claim 1, including no more than six outlets.

4. A shower head as claimed in claim 1, wherein:

an angle of convergence between the outlet emission axis of each outlet and the mean trajectory of the shower head is adjustable.

5. A shower head as claimed in claim 1, wherein:

the shower head is arranged to cause the air to form an air vortex in each mixing chamber.

6. A shower head as claimed in claim 5, wherein:

the air inlet to each mixing chamber is fed by a respective air feed chamber, and the shower head is arranged to cause the air to form the air vortex both in the air feed chamber and in the mixing chamber.

7. A shower head as claimed in claim 5, further including:

means for adjusting the strength of the air vortex in each mixing chamber.

8. A shower head as claimed in claim 1, wherein:

the shower head is arranged to cause the water to form a water vortex in each mixing chamber.

9. A shower head as claimed in claim 8, wherein:

the water inlet to each mixing chamber is fed by a respective water feed chamber, and the shower head is arranged to cause the water to form the water vortex both in the water feed chamber and in the mixing chamber.

10. A shower head as claimed in claim 1, wherein:

a deflector is disposed in each mixing chamber in alignment with the respective water inlet so that, in use, water impinges on the deflector in the mixing chamber.

11. A shower head as claimed in claim 5, wherein:

the shower head is arranged to cause the water to form a water vortex in each mixing chamber.

12. A shower head as claimed in claim 11, wherein:

the water inlet to each mixing chamber is fed by a respective water feed chamber, and the shower head is arranged to cause the water to form the water vortex both in the water feed chamber and in the mixing chamber.

13. A shower head as claimed in claim 1, wherein the outlet of each mixing chamber is adjustable to adjust an angle of convergence between the outlet emission axis of each outlet and the mean trajectory of the shower head.

14. A shower head as claimed in claim 13, wherein each mixing chamber further includes two overlapping portions between the water inlet and the outlet, and a seal between the overlapping portions, wherein the overlapping portions are rotatable relative to each other to adjust an angle of convergence between the outlet emission axis of each outlet and the mean trajectory of the shower head.

15. A shower head as claimed in claim 14, wherein each mixing chamber further includes a divergent section adjacent the water inlet and a convergent section adjacent the outlet, the overlapping portions being between the divergent section and the convergent section, the convergent section being adjustable relative to the divergent section.

* * * * *